US012807295B2

(12) United States Patent
Tagata et al.

(10) Patent No.: US 12,807,295 B2
(45) Date of Patent: Nov. 24, 2026

(54) BOAT CONTROL SYSTEM AND BOAT

(71) Applicant: YAMAHA HATSUDOKI KABUSHIKI KAISHA, Iwata (JP)

(72) Inventors: Akihiro Tagata, Shizuoka (JP); Katsutoshi Naito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 1 day.

(21) Appl. No.: 19/037,385

(22) Filed: Jan. 27, 2025

(65) Prior Publication Data

US 2025/0242902 A1 Jul. 31, 2025

(30) Foreign Application Priority Data

Jan. 31, 2024 (JP) ..... 2024-012366

(51) Int. Cl.
*B63H 25/02* (2006.01)
*B63H 25/42* (2006.01)

(52) U.S. Cl.
CPC ..... *B63H 25/02* (2013.01); *B63H 25/42* (2013.01)

(58) Field of Classification Search
CPC ..... B63H 20/10; B63H 20/12; B63H 2020/005; B63H 25/02; B63H 25/42
See application file for complete search history.

(56) References Cited

U.S. PATENT DOCUMENTS 6,491,554 B1 * 12/2002 Servais ..... B63H 11/107 440/40
9,381,989 B1 * 7/2016 Poirier ..... B63H 5/125
9,487,283 B2 * 11/2016 Inoue ..... B63H 20/10
10,059,415 B1 8/2018 Anschuetz et al.
10,167,057 B1 * 1/2019 Terada ..... B63B 1/32
10,766,589 B1 * 9/2020 Ito ..... G05D 1/0206
11,511,833 B2 * 11/2022 Inoue ..... B63B 39/061
11,753,132 B1 * 9/2023 Nakayasu ..... B63H 20/12 701/21
2008/0233812 A1 * 9/2008 Kawanishi ..... B63H 20/10 440/1
2010/0191396 A1 * 7/2010 Nose ..... B63H 25/42 701/21
2010/0191397 A1 * 7/2010 Nose ..... B63H 25/42 701/21

(Continued)

FOREIGN PATENT DOCUMENTS

EP 4253224 A1 10/2023
JP H0417833 B2 3/1992

OTHER PUBLICATIONS

Official Communication issued in corresponding European Patent Application No. 25154899.6, mailed on Jul. 30, 2025, 9 pages.

*Primary Examiner* — Tyler J Lee
(74) *Attorney, Agent, or Firm* — Keating & Bennett, LLP

(57) ABSTRACT

A boat control system to control a boat including a boat body includes a boat propulsion device including a steering device to change a steering angle and a tilting device to perform tilt operations, and a controller configured or programmed to control the steering device and the tilting device. Upon receiving a tilt operation instruction when the steering angle of the boat propulsion device is in a state different from a neutral state, the controller is configured or programmed to (i) drive the steering device to steer the boat propulsion device until the steering angle of the boat propulsion device reaches the neutral state, and (ii) drive the tilting device to perform the tilt operation at the same time as (i) or after the start of (i).

14 Claims, 5 Drawing Sheets

(56) References Cited

U.S. PATENT DOCUMENTS

| | | | | |
|---|---|---|---|---|
| 2011/0166724 | A1* | 7/2011 | Hiramatsu | B63H 25/42 702/85 |
| 2016/0201776 | A1* | 7/2016 | Takase | F16H 25/2204 74/99 R |
| 2021/0147054 | A1* | 5/2021 | Kadobayashi | B63H 20/12 |
| 2021/0291943 | A1* | 9/2021 | Inoue | B63B 39/061 |
| 2022/0144401 | A1* | 5/2022 | Malouf | B63H 20/12 |
| 2023/0202632 | A1* | 6/2023 | Hirao | B63H 20/12 701/21 |
| 2023/0278689 | A1* | 9/2023 | Saruwatari | B63H 20/32 440/53 |

* cited by examiner

BOAT CONTROL SYSTEM AND BOAT

CROSS REFERENCE TO RELATED APPLICATIONS

This application claims the benefit of priority to Japanese Patent Application No. 2024-012366 filed on Jan. 31, 2024. The entire contents of this application are hereby incorporated herein by reference.

BACKGROUND OF THE INVENTION

1. Field of the Invention

The technologies disclosed herein relate to boat control systems and boats.

2. Description of the Related Art

A boat equipped with a propulsion unit (boat propulsion unit) and a tilting device for tilting the propulsion unit is known. In such boats, in order to avoid interference with other boats when the propulsion unit is in a tilt position, it has been proposed to install a switching means that allows the supply of electricity to the electric pump unit that supplies hydraulic oil to the tilting device when the steering angle is in a neutral position, and blocks the supply when the steering angle is in any other position (see JPH 04-17833 B2).

In the configuration described above, if the steering position of the boat propulsion device is not in the neutral position, the user must return the steering position to the neutral position before performing the tilt up operation, which is time-consuming.

SUMMARY OF THE INVENTION

Example embodiments of the present invention disclose technologies that can solve one or more of the above-mentioned problems.

One or more of the technologies disclosed herein can be implemented in the following example embodiments, for example.

A boat control system to control a boat including a boat body includes a boat propulsion device including a steering device to change a steering angle and a tilting device to perform tilt operations, and a controller configured or programmed to control the steering device and the tilting device, wherein upon receiving a tilt operation instruction when the steering angle of the boat propulsion device is in a state different from a neutral state, the controller is configured or programmed to (i) drive the steering device to steer the boat propulsion device until the steering angle of the boat propulsion device reaches the neutral state, and (ii) drive the tilting device to perform the tilt operation at a same time as (i) or after a start of (i).

One or more of the technologies disclosed herein can be implemented in various example embodiments, including, e.g., boats, controllers provided on boats, control methods for boats, computer programs for implementing functions or methods of the devices, and non-transitory computer readable media including computer programs, among other example embodiments and modifications thereof.

One or more of the technologies disclosed herein reduce user workloads during tilt operations.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
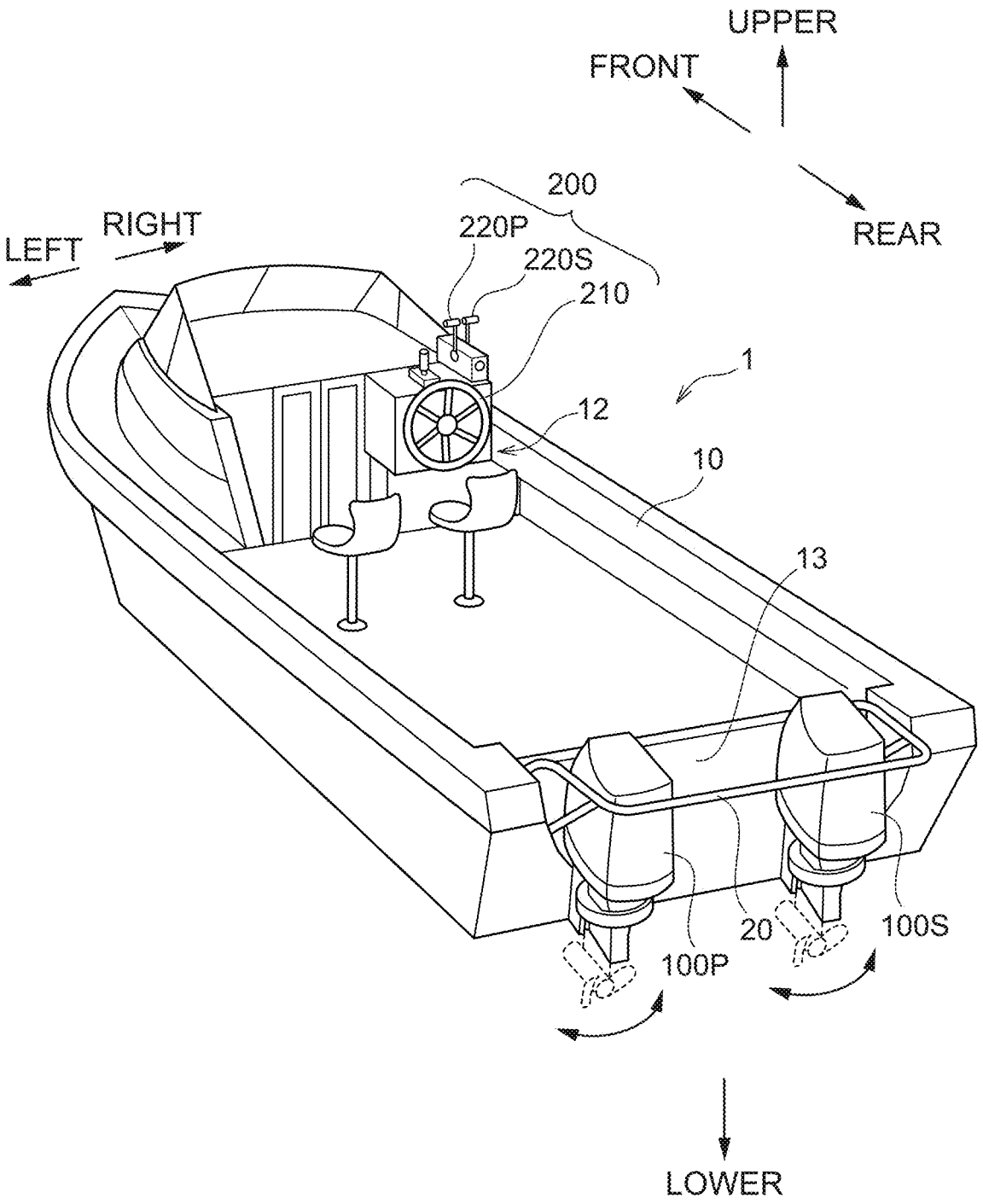
FIG. 1 is a perspective view schematically illustrating a configuration of a boat according to an example embodiment of the present invention.

Example embodiments of the present invention will be explained with reference to FIGS. 1 to 5. A boat 1 according to an example embodiment may, for example, tow a wakeboard, and includes, as shown in FIGS. 1 and 3, a boat body 10 including a frame 20, a first outboard motor 100P (an example of a boat propulsion device), a second outboard motor 100S (an example of a boat propulsion device), an operation device 200, a controller 300, a notification device (notifier) 400, and an input port 500. The boat control system 600 includes the outboard motors 100P, 100S, the operation device 200, the controller 300, the notification device 400, and the input port 500.

FIG. 1 and the other figures to follow show arrows representing each direction with respect to a position of the boat 1. More specifically, each drawing shows arrows representing front (FRONT), rear (REAR), left (LEFT), right (RIGHT), upper (UPPER), and lower (LOWER) directions. The front-rear, left-right, and upper-lower (vertical) directions are orthogonal to each other.

The boat body 10 is a portion of the boat 1 for occupants to ride. The boat body 10 includes a pilot seat 12 as shown in FIG. 1. A transom board 13 is provided at the stern of the boat body 10 to attach the outboard motors 100P, 100S.

The frame 20 fixes the towing rope to tow a wakeboard, and as a whole has a U-shape, with both ends attached to the two ends of the transom board 13.

The outboard motors 100P, 100S are attached to the transom board 13 and produce thrusts to propel the boat body 10. As shown in FIG. 1, the two outboard motors 100P, 100S are located between the transom board 13 and the frame 20. The first outboard motor 100P is located on the port-side of the boat body 10, and the second outboard motor 100S is located on the starboard-side of the boat body 10.

The configuration of the first outboard motor 100P is explained in detail below. Since the second outboard motor 100S has the same structure as the first outboard motor 100P, identical parts or elements are marked with identical symbols, and descriptions thereof are omitted. When the elements provided in the first outboard motor 100P and those provided in the second outboard motor 100S are described separately, "P" is added to the end of the sign of the elements provided in the first outboard motor 100P, and "S" is added to the end of the sign of the elements provided in the second outboard motor 100S.

The first outboard motor 100P includes a tilting device 170P and an outboard motor main body 101 that is attached to the stern of the boat body 10 via the tilting device 170P. The outboard motor main body 101 is supported by the tilting device 170P so that it can be rotated between a tilt-down state in which the propeller 140 described below is located underwater, and a tilt-up state in which the propeller 140 is located above the water surface. In the following, the outboard motor 100P in a reference attitude (attitude shown in FIG. 2) will be described unless otherwise noted. The reference attitude is one in which the rotation axis Ad of the drive shaft 124, which is described below, extends in the upper-lower direction and the rotation axis Ap of the propeller shaft 142 extends in the front-rear direction.

Figure 2:
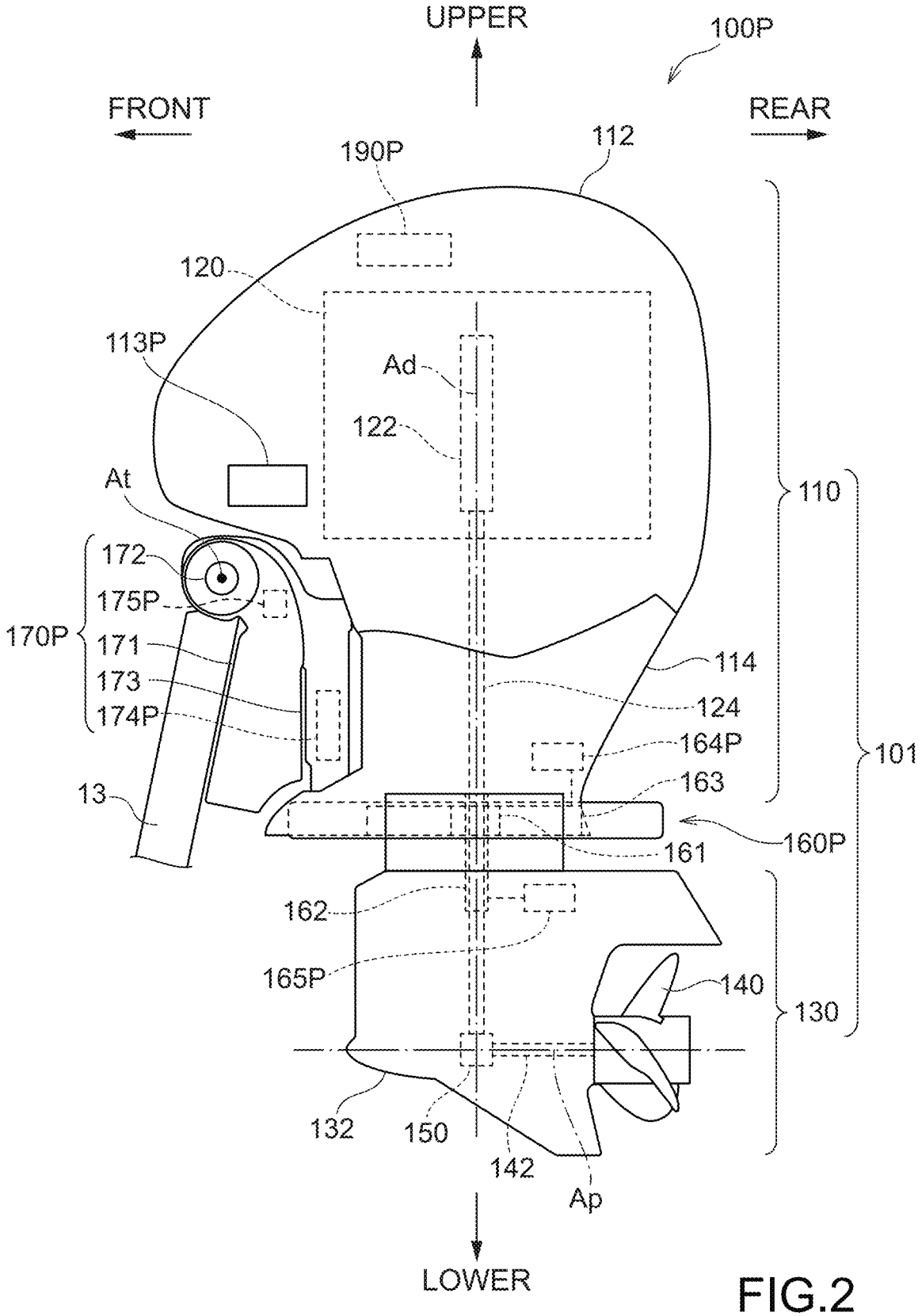
FIG. 2 is a side view schematically illustrating a configuration of an outboard motor according to an example embodiment of the present invention.
Figure 3:
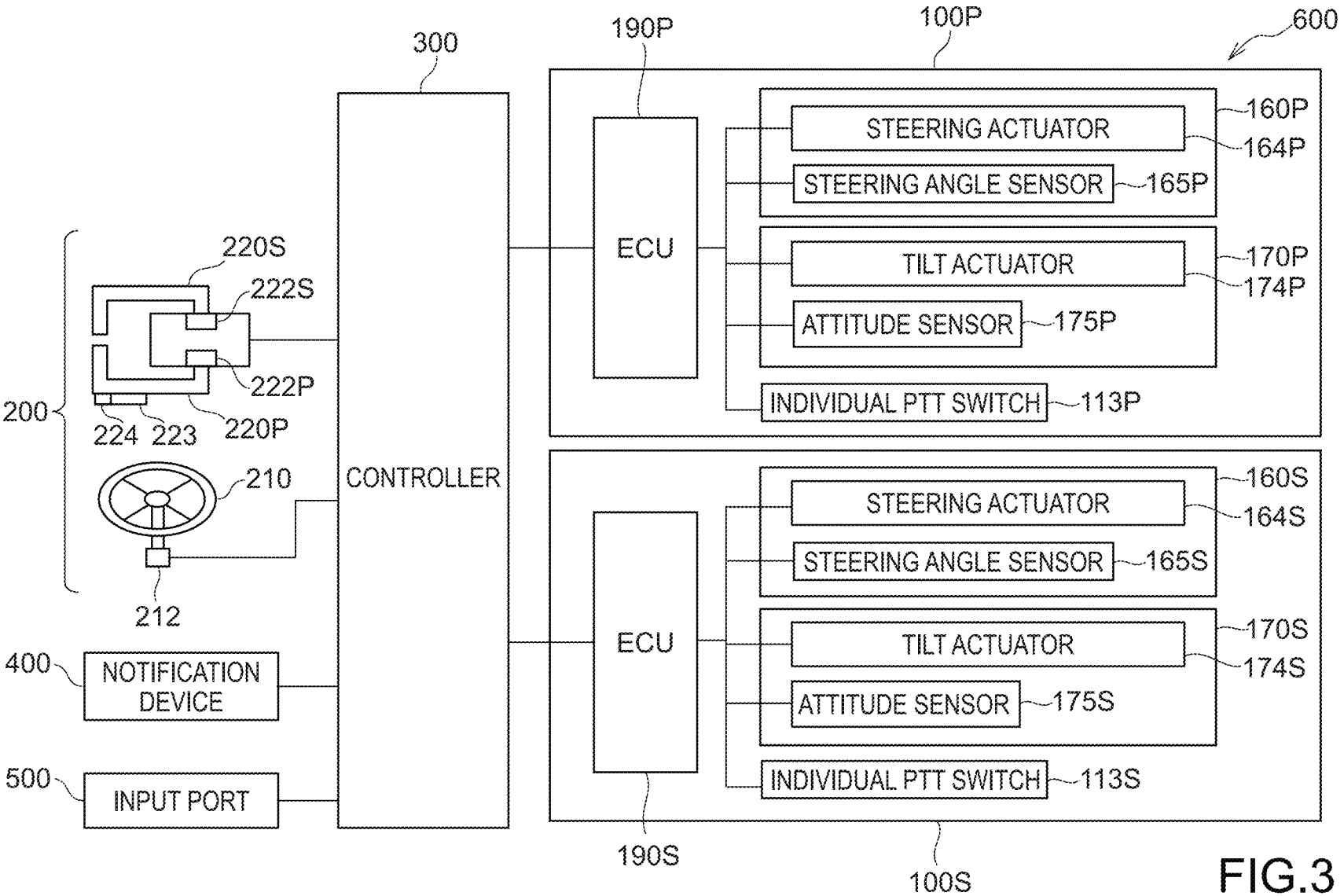
FIG. 3 is a block diagram illustrating a configuration of a boat control system according to an example embodiment of the present invention.

As shown in FIG. 2, the outboard motor main body 101 includes an upper unit 110, a lower unit 130, and a steering device 160P. The upper unit 110 is attached to the boat body 10 via the tilting device 170P. The lower unit 130 is arranged below the upper unit 110. The steering device 160P is interposed between the upper unit 110 and the lower unit 130.

The upper unit 110 includes a cowl 112, an upper case 114, an engine 120, a drive shaft 124, an electronic control unit (ECU) 190P, and an individual PTT switch 113P, as shown in FIG. 2.

The cowl 112 is a housing located on top of the outboard motor 100P. The upper case 114 is a housing unit arranged below the cowl 112 and is attached to the boat body 10 via the tilting device 170P.

The engine 120 is a prime mover to generate power to drive the outboard motor 100P and is located inside the cowl 112. The engine 120 has a known configuration including a cylinder block (not shown) provided with a plurality of cylinders (not shown), a piston (not shown) disposed inside each cylinder and reciprocating as a mixture of fuel and air is burned, and a crankshaft 122 rotating as the piston reciprocates. The crankshaft 122 is arranged in an attitude extending in the upper-lower direction as shown in FIG. 2.

The drive shaft 124 is a rod-shaped structure connected to the lower end of the crankshaft 122 and positioned in an attitude in which its rotation axis Ad extends in the upper-lower direction. The drive shaft 124 rotates along with the rotation of the crankshaft 122. Most of the drive shaft 124 is located inside the cowl 112 and the upper case 114. The lower end of the drive shaft 124 protrudes downward from the upper case 114 and extends into the interior of the lower unit 130.

The ECU 190P is located inside the cowl 112. The ECU 190P includes a processor such as a central processing unit (CPU) and a storage device such as read only memory (ROM) and random access memory (RAM). The storage device stores various programs and data to control the outboard motor 100P.

The individual PTT switch 113P is provided on the outer surface of the cowl 112. The individual PTT switch 113P accepts instructions for tilt/trim operation of the outboard motor 100P, that is, operation to rotate the outboard motor 100P between the tilt-down state and the tilt-up state. One end of the individual PTT switch 113P is an UP button and the other end is a DN button. The UP button is used to rotate the outboard motor main body 101 in the direction in which the lower unit 130 moves upward. The DN button is used to rotate the outboard motor main body 101 in the direction in which the lower unit 130 moves downward. The individual PTT switch 113P is a momentary switch. In other words, the UP button and DN button are each only ON while being pressed, and OFF while not being pressed.

The lower unit 130, as shown in FIG. 2, includes a lower case 132, a propeller 140, a propeller shaft 142, and a shift mechanism 150.

The lower case 132 is a housing arranged below the upper case 114.

The propeller 140 is a rotating structure including a plurality of blades and generates a thrust by rotating. The propeller shaft 142 is a rod-shaped structure and is arranged in an attitude extending in the front-rear direction. The rear end of the propeller shaft 142 protrudes outside the lower case 132, and the remaining portion is housed within the lower case 132. The propeller 140 is attached to the rear end of the propeller shaft 142. As the propeller shaft 142 rotates about the rotation axis Ap, the propeller 140 also rotates.

The shift mechanism 150 is connected to the lower end of the drive shaft 124 and to the front end of the propeller shaft 142. The shift mechanism 150 has a known configuration including, e.g., a forward gear, a backward gear, and a clutch. The shift state of the outboard motor 100P is switched among the forward movement state, the backward movement state, and the neutral state by switching the engagement of the clutch to the two gears. The forward movement state is a state in which the clutch engages the forward gear, the rotation of the drive shaft 124 is transmitted to the propeller shaft 142 as forward rotation, and the propeller 140, which rotates in the forward direction with the propeller shaft 142, creates a thrust in the forward direction. The backward movement state is a state in which the clutch engages the backward gear, the rotation of the drive shaft 124 is transmitted to the propeller shaft 142 as reverse rotation, and the propeller 140, which rotates in the reverse direction the with propeller shaft 142, produces a thrust in the backward direction. The neutral state is a state in which the clutch is not engaged with either the forward gear or the backward gear, so that the rotation of the drive shaft 124 is not transmitted to the propeller shaft 142 and the propeller 140 does not create any thrust.

The steering device 160P changes the direction of the thrust produced by the outboard motor 100P and is configured to rotate the lower unit 130 relative to the upper unit 110. As shown in FIG. 2, the steering device 160P has a known configuration including a pinion 161 that rotates along with the lower unit 130, a steering shaft 162 that is attached to the pinion 161 and through which the drive shaft 124 can be inserted, a rack 163 that engages the pinion 161 and moves linearly, a steering actuator 164P that is a drive device to linearly move the rack 163, and a steering angle sensor 165P to detect the steering angle of the outboard motor 100P. The steering actuator 164P includes, e.g., an electric motor. When the rack 163 is moved linearly by the driving force of the steering actuator 164P, the pinion 161 rotates. This rotation causes the lower unit 130 to rotate around the rotation axis Ad of the drive shaft 124 as the steering axis. In conjunction with this rotation, the propeller shaft 142 rotates about the rotation axis Ad. The steering angle sensor 165P detects the rotation angle of the steering shaft 162. The steering angle sensor 165P outputs a steering angle signal indicating the steering angle of the outboard motor 100P.

Figure 4:
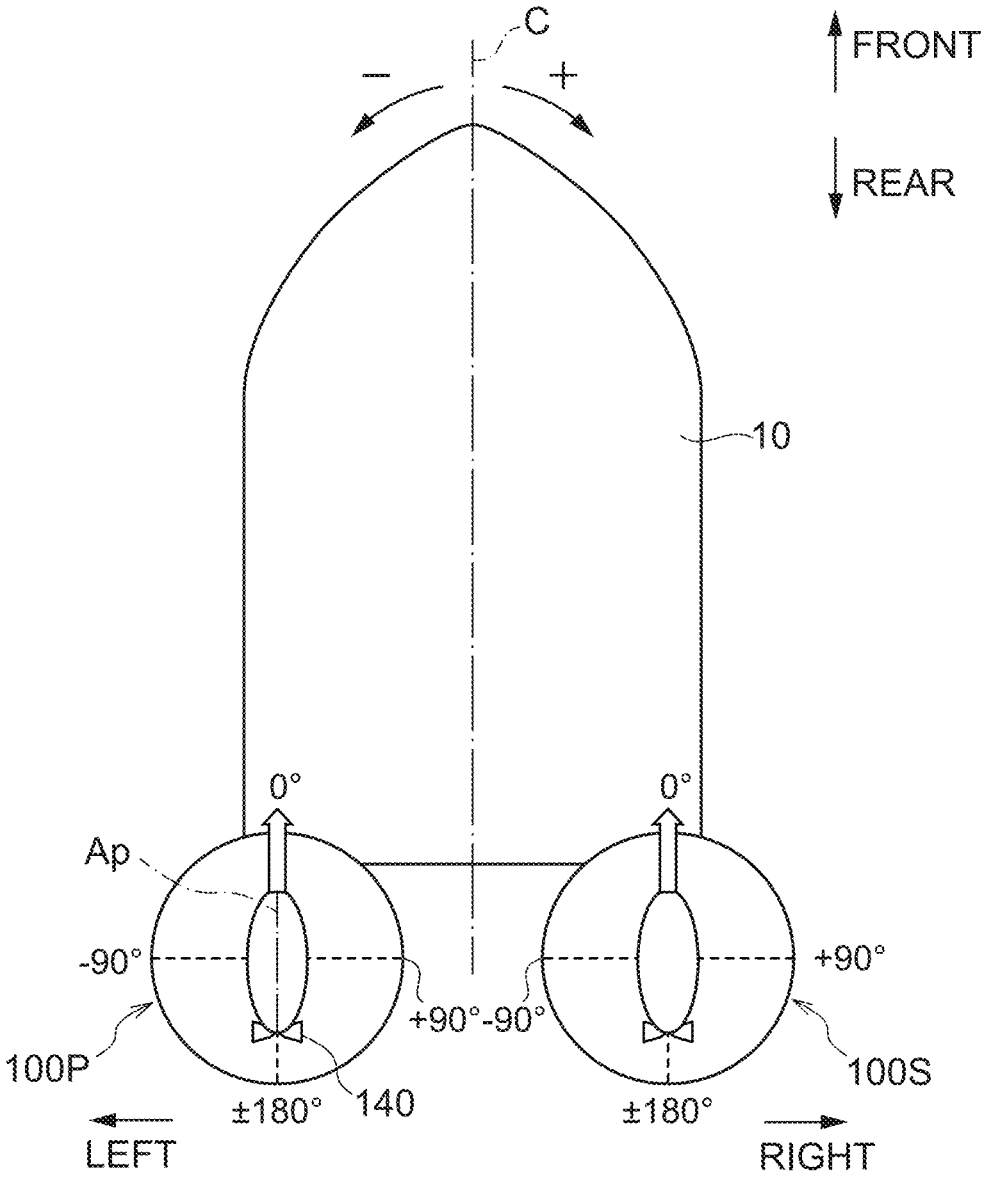
FIG. 4 is a schematic view for explaining a steering angle of the outboard motor according to an example embodiment of the present invention.
Figure 5:
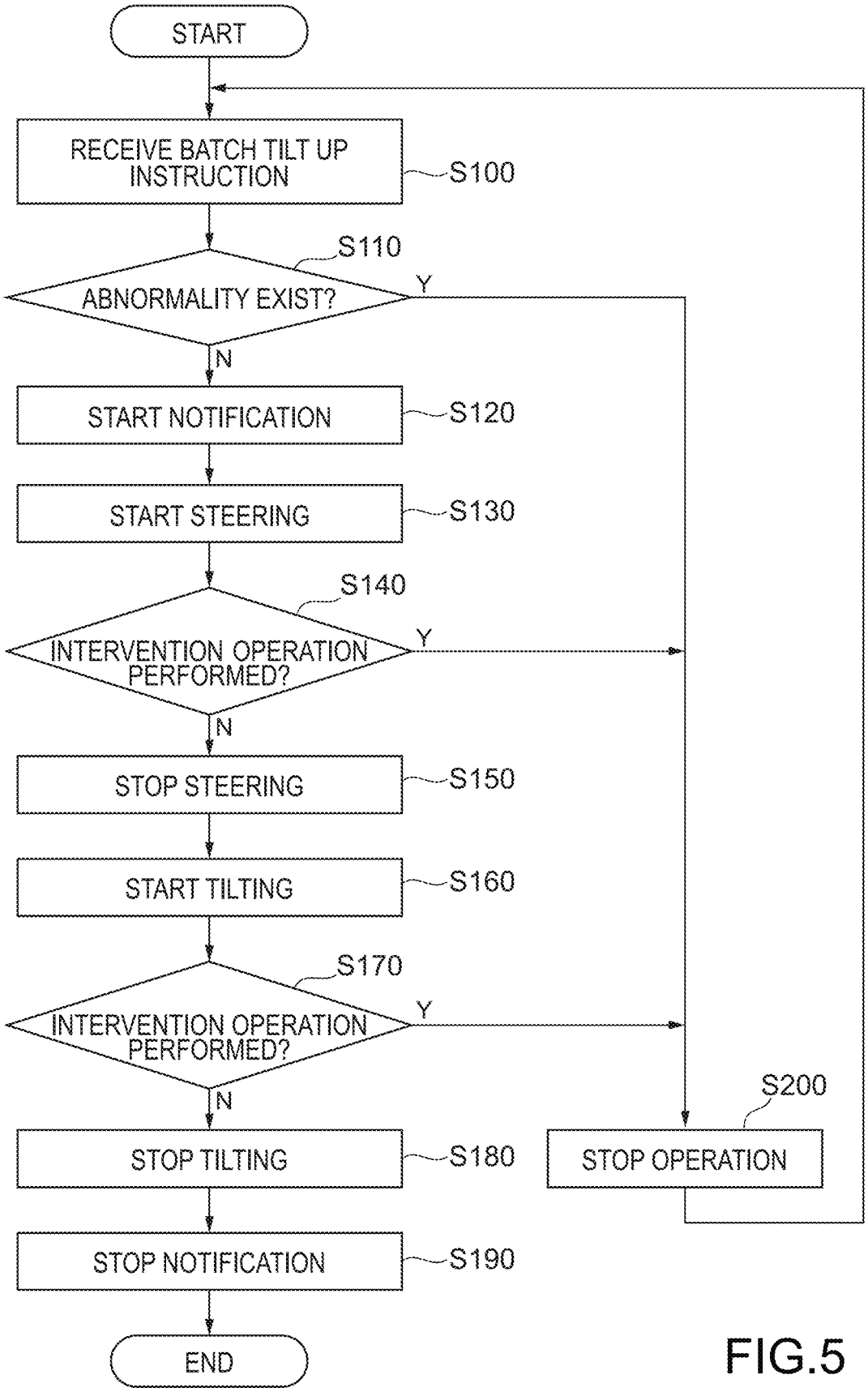
FIG. 5 is a flowchart showing a flow of a control of the outboard motor according to an example embodiment of the present invention.

In this specification, the steering angle is defined as follows. As shown in FIG. 4, the steering angle is 0° when the orientation of the lower unit 130 is such that the rotation axis Ap of the propeller shaft 142 is parallel to the centerline C of the boat body 10 and the propeller 140 is directed rearward. Then, the clockwise rotation of the lower unit 130, viewed from above, is referred to as positive turning, and the counterclockwise rotation is referred to as negative turning. The rotation angle of the propeller shaft 142 from the position where the steering angle is 0° is the steering angle. In this specification, the steering angle being in the neutral state means that the steering angle is almost 0°. The steering angle being almost 0° does not only mean that the steering angle is exactly 0°, but also includes cases where the steering angle is slightly off from 0° within the range where there is no hindrance to the tilt operation of the outboard motors 100P, 100S. For example, when the steering angle is within the range of 0°±1°, the steering angle may be considered to be in the neutral state.

The tilting device 170P suspends the outboard motor main body 101 to the boat body 10. As shown in FIG. 2, the tilting device 170P includes a pair of left and right clamp brackets 171, a tilt shaft 172, a swivel bracket 173, a tilt actuator 174P, and an attitude sensor 175P.

The pair of left and right clamp brackets 171 are arranged in a state in which they are separated from each other in the left-right direction at the stern of the boat body 10, and are fixed to the transom board 13, by using e.g., bolts. The tilt shaft 172 is a rod-shaped structure that is supported by the clamp brackets 171 in a rotatable manner. The tilt axis At, which is the centerline of the tilt shaft 172, extends in a horizontal direction. The swivel bracket 173 is sandwiched between the pair of clamp brackets 171 and is supported by the clamp brackets 171. The swivel bracket 173 is rotatable with respect to the clamp brackets 171 about the tilt axis line At as the rotation axis. The tilt actuator 174P rotates the swivel bracket 173 about the tilt axis At, and includes, e.g., a hydraulic cylinder. The tilt actuator 174P is, e.g., located in a position lower than the tilt shaft 172 in the space between the pair of clamp brackets 171. The attitude sensor 175P detects the tilt/trim angle of the outboard motor 100P. The tilt/trim angle is the angle of rotation of the outboard motor main body 101 with respect to the outboard motor 100P in its reference attitude (0°). The attitude sensor 175P includes, e.g., a potentiometer. The attitude sensor 175P outputs an angle signal indicating the tilt/trim angle of the outboard motor 100P.

When the swivel bracket 173 rotates about the tilt axis At with respect to the clamp bracket 171, the outboard motor 100P supported by the swivel bracket 173 also rotates about the tilt axis At. This causes a tilting action of rotating the outboard motor main body 101 between the tilt-down state in which the propeller 140 is located underwater, and the tilt-up state in which the outboard motor 100P is tilted so that the propeller 140 is located above the water surface. In addition, the tilting device 170P can also perform trimming action that adjusts the attitude of the boat 1 during traveling by adjusting the angle about the tilt axis At of the outboard motor main body 101 in the tilt-down state where the propeller 140 is positioned underwater.

The operation device 200 is installed near the pilot seat 12 and accepts operations to control the movement of the boat body 10 conducted by the steering person. As shown in FIGS. 1 and 3, the operation device 200 includes a steering wheel 210 and shift/throttle levers 220P, 220S.

The steering wheel 210 accepts operations by the steering person to instruct the turning direction of the boat body 10 and is rotatable. As shown in FIG. 3, a steering sensor 212 is connected to the steering wheel 210. The steering sensor 212 outputs a steering signal indicating the direction and angle of rotation of the steering wheel 210.

The shift/throttle levers 220P, 220S accept operations by the steering person to instruct switching of the magnitude of thrust and the shift state of the two outboard motors 100P, 100S, respectively. The shift/throttle levers 220P, 220S can be moved forward and backward from the neutral position.

A remote PTT switch 223 is provided on an outer surface of the shift/throttle lever 220P. The remote PTT switch 223 includes a batch PTT switch 224. The batch PTT switch 224 accepts a batch tilt up instruction (an example of the tilt operation) to tilt up both the first outboard motor 100P and the second outboard motor 100S at once. In addition to the batch PTT switch 224, the remote PTT switch 223 may also include switches to separately accept a tilt/trim operation instruction for the first outboard motor 100P and a tilt/trim operation instruction for the second outboard motor 100S.

As shown in FIG. 3, throttle sensors 222P, 222S are connected to the shift/throttle levers 220P, 220S, respectively. The throttle sensors 222P, 222S output throttle signals indicating the operation direction and operation amount of the shift/throttle levers 220P, 220S, respectively. Furthermore, the throttle sensor 222P outputs a tilt signal to indicate that the remote PTT switch 223 has been operated. In addition, the throttle sensor 222P outputs an all-tilt signal when the batch PTT switch 224 is operated.

The controller 300 includes, e.g., a CPU, a multi-core CPU, and a programmable device (e.g., Field programmable gate array (FPGA), programmable logic device (PLD)). The controller 300 controls the operation of the boat body 10. In other words, the controller 300 controls the magnitude and direction of the thrust of the outboard motors 100P, 100S, respectively, according to the operations accepted by the operation device 200.

The controller 300 includes a storage device. The storage device includes, e.g., ROM, RAM, hard disk drive (HDD), and solid-state drive (SDD). The storage device stores various programs and data and is used as a work area or data storage area when executing various processes. For example, a computer program to execute the steering angle change process described below is stored in the storage device. This computer program is provided, e.g., in a non-transitory computer-readable recording medium such as a CD-ROM, DVD-ROM, or USB memory (not shown), or it can be obtained from an external device (e.g., a server in the cloud) via a communication interface (not shown) and stored in a storage device in a manner that can be executed on the boat control system 600.

The controller 300 is communicatively connected to the ECU 190P, 190S, the steering sensor 212, and the throttle sensors 222P, 222S. The steering actuator 164P, the tilt actuator 174P, the steering angle sensor 165P, the attitude sensor 175P, and the individual PTT switch 113P are communicatively connected to the ECU 190P and are able to communicate with the controller 300 via the ECU 190P. The steering actuator 164S, the tilt actuator 174S, the steering angle sensor 165S, the attitude sensor 175P, and the individual PTT switch 113S are communicatively connected to the ECU 190S and are able to communicate with the controller 300 via the ECU 190S.

The controller 300 receives steering signals from the steering sensor 212, throttle signals from the throttle sensors 222P, 222S, and tilt signals from the throttle sensor 222P. The controller 300 receives the steering angle signal from the steering angle sensor 165P and the angle signal from the attitude sensor 175P via the ECU 190P, and receives the steering angle signal from the steering angle sensor 165S and the angle signal from the attitude sensor 175S via the ECU 190S. The controller 300 outputs command signals to the ECU 190P, 190S based on these signals. The ECU 190P outputs command signals to the steering actuator 164P and the tilt actuator 174P according to the command signals from the controller 300. The ECU 190S outputs command signals to the steering actuator 164S and the tilt actuator 174S according to the command signals from the controller 300.

The notification device 400 emits warning information to inform the surroundings in or around the boat 1 that the tilt operation of the outboard motors 100P, 100S is about to be performed. The notification device 400 includes a speaker, e.g., and the warning information is a warning sound, such as a buzzer sound, emitted from the speaker, for example. The notification device 400 is communicatively connected to the controller 300. The controller 300 outputs command signals to the notification device 400 to indicate the start and stop of the output of the warning sound.

The input port 500 accepts signals from external devices (not shown in the figure) and is communicatively connected to the controller 300. The input port 500 receives signals from external devices via wired or wireless connections. The external device may be a computer device such as a personal computer (PC), in which tool software for setting the operating conditions of the boat control system 600 is installed. When a serviceperson of the boat builder or dealer inputs the setting information for the operating conditions into the external device, the controller 300 receives the setting information via the input port 500.

When the boat 1 is controlled in the normal steering mode, in which the boat 1 is mainly steered using the steering wheel 210 and the shift/throttle levers 220P, 220S, the controller 300 receives steering signals from the steering sensor 212 and throttle signals from the throttle sensors 222P, 222S. The controller 300 controls the thrust and steering angle of the outboard motors 100P, 100S based on these signals.

The controller 300 outputs command signals corresponding to the rotating direction of the steering wheel 210 to the steering actuators 164P, 164S via the ECU 190P, 190S. The steering actuator 164P controls the steering device 160P based on the received command signal to change the orientation of the lower unit 130, that is, the steering angle of the first outboard motor 100P. Similarly, the steering actuator 164S controls the steering device 160S based on the received command signal to change the orientation of the lower unit 130, that is, the steering angle of the second outboard motor 100S.

When the controller 300 detects that the individual PTT switch 113P has been operated by the user, the controller 300 controls the tilt/trim operation of the first outboard motor 100P.

The controller 300 detects, via the ECU 190P, whether or not the UP button provided on the individual PTT switch 113P is being pressed, that is, whether or not the UP button is turned on. The controller 300 continues to send command signals to the tilt actuator 174P via the ECU 190P to instruct tilt/trim operation while the UP button is detected as being ON. The tilt actuator 174P drives the tilting device 170P based on the received command signal, and keeps rotating the outboard motor main body 101 in the direction in which the lower unit 130 moves upward. When the controller 300 detects that the UP button is no longer being operated and has turned OFF, it stops sending the command signal. When the tilt actuator 174P stops receiving command signals, it stops the rotation of the outboard motor main body 101 by the tilting device 170P.

The controller 300 detects, via the ECU 190P, whether or not the DN button provided on the individual PTT switch 113P is pressed, that is, whether or not the DN button is turned ON. The controller 300 continues to send command signals to the tilt actuator 174P via the ECU 190P to instruct the tilt/trim operation while the DN button is pressed, that is, while the DN button is detected as being ON. The tilt actuator 174P drives the tilting device 170P based on the received command signal, and keeps rotating the outboard motor main body 101 in the direction in which the lower unit 130 moves downward. When the controller 300 detects that the DN button is no longer being operated and has turned OFF, it stops sending the command signal. When the tilt actuator 174P stops receiving command signals, it stops the rotation of the outboard motor main body 101 by the tilting device 170P.

When the controller 300 accepts a tilt/trim operation instruction issued by using the individual PTT switch 113P, the controller 300 may perform the tilt/trim operation on the first outboard motor 100P without returning the steering angle of the first outboard motor 100P to the neutral state, but maintaining the steering angle at the time the tilt/trim operation instruction was accepted.

The control of the tilt/trim operation when the individual PTT switch 113S provided for the second outboard motor 100S is operated is the same as for the first outboard motor 100P.

When the controller 300 receives a batch tilt up instruction from the user, the controller 300 executes the batch tilt up of the outboard motors 100P, 100S. For example, the batch tilt up instruction is issued when the user presses the batch PTT switch 224 twice within a predetermined time. The batch tilt up procedure is explained with reference to FIG. 5.

When the controller 300 receives an all-tilt signal from the throttle sensor 222P indicating that the user has issued a batch tilt up instruction (S100), the controller 300 proceeds to step S110.

In step S110, the controller 300 determines whether there is an abnormality in the steering devices 160P, 160S and the tilting devices 170P, 170S. For example, if the controller 300 does not receive a steering angle signal indicating the current steering angle of the outboard motor 100P, 100S from the steering angle sensor 165P, 165S, or if the steering angle instructed by the controller 300 does not match the steering angle detected by the steering angle sensor 165P, 165S, the controller 300 determines that there is an abnormality in the steering devices 160P, 160S. In addition, if the controller 300 does not receive an angle signal indicating the current tilt/trim angle of the outboard motor 100P, 100S from the attitude sensor 175P, 175S, or if the tilt/trim angle instructed by the controller 300 does not match the tilt/trim angle detected by the attitude sensors 175P, 175S, the controller 300 determines that there is an abnormality in the tilting devices 170P, 170S.

When it is determined that there is an abnormality in either or both of the steering devices 160P, 160S and the tilting devices 170P, 170S, the controller 300 will proceed to step S200 and cancel the batch tilt up operation. When it is determined that there is no abnormality in either the steering devices 160P, 160S or the tilting device 170P, 170S, the controller 300 proceeds to step S120.

In step S120, the controller 300 outputs a command signal to the notification device 400 to instruct the notification device 400 to start outputting a warning sound. The notification device 400 outputs a warning sound based on the received command signal. The notification device 400 continues to output a warning sound until it receives a command signal from the controller 300 indicating that the output of the warning sound should be stopped. By outputting a warning sound, the batch tilt-up operation can be performed after alerting the surroundings. After outputting the command signal to the notification device 400, the controller 300 proceeds to step S130. The controller 300 may proceed to step S130 after the predetermined standby time has elapsed after outputting the command signal to the notification device 400. This is to provide enough time to alert the surroundings by outputting the warning sound.

In step S130, the controller 300 receives a steering angle signal from the steering angle sensor 165P indicating the steering angle of the first outboard motor 100P, and if the steering angle is not in the neutral state, the controller 300 outputs a command signal to the steering actuator 164P via the ECU 190P to set the steering angle of the first outboard motor 100P to the neutral state. The steering actuator 164P controls the steering device 160P based on the received command signal to change the orientation of the lower unit 130, i.e., the steering angle of the first outboard motor 100P, until it reaches the neutral state. The controller 300 receives a steering angle signal from the steering angle sensor 165S indicating the steering angle of the second outboard motor 100S, and if the steering angle is not in the neutral state, the controller 300 outputs a command signal to the steering actuator 164S via the ECU 190S to set the steering angle of the second outboard motor 100S to the neutral state. The steering actuator 164S controls the steering device 160S based on the received command signal to change the orientation of the lower unit 130, i.e., the steering angle of the second outboard motor 100S, until it reaches the neutral state. In other words, when receiving a batch tilt up instruction from the user, if the steering angles of both of the outboard motors 100P, 100S are not in the neutral state, the controller 300 may steer both of the outboard motors 100P, 100S until the steering angles reaches the neutral state, and if the steering angle of one of the two outboard motors 100P, 100S is not in the neutral state, the controller 300 may steer the outboard motor until the one steering angle reaches the neutral state. When steering both of the outboard motors 100P, 100S, the two outboard motors 100P, 100S may be steered in parallel. Because the operation to set the steering angle of the outboard motors 100P, 100S to the neutral state is performed prior to tilting up the outboard motors 100P, 100S, the user does not need to perform the operation to set the steering angle of the outboard motors 100P, 100S to the neutral state in advance, and only needs to perform the operation to instruct the batch tilt up. This reduces the amount of work required by the user when performing the batch tilt up.

After outputting the command signal to the steering actuators 164P, 164S, the controller 300 proceeds to step S140.

At S140, the controller 300 determines whether or not an intervention operation has been performed by the user to cancel the batch tilt up. The controller 300 determines that an intervention operation has been performed when, e.g., the controller 300 receives an instruction from the user for a steering operation or a trim operation after receiving an all-tilt signal (S100). An example of the steering operation instruction from the user may be rotation of the steering wheel 210. An example of the trim operation instruction from the user may be pressing of any of the PTT switches 113P, 113S, 223. When a user accidentally operates the batch PTT switch 224, the user will often perform the above actions instantly to cancel the operation. Therefore, when these actions are detected, it is possible to easily stop the batch tilt up operation by determining that an intervention operation has been performed.

When it is determined that an intervention operation has been performed, the controller 300 proceeds to step S200 and stops the batch tilt up operation. When it is determined that there has been no intervention operation, the controller 300 continues the steering operation without any other operation.

The controller 300 receives a steering angle signal from the steering angle sensor 165P indicating the steering angle of the first outboard motor 100P, and when it is determined that the steering angle of the first outboard motor 100P has reached the neutral state, the controller 300 stops the steering of the first outboard motor 100P. The controller 300 receives a steering angle signal from the steering angle sensor 165S indicating the steering angle of the second outboard motor 100S, and when it is determined that the steering angle of the second outboard motor 100S has reached the neutral state, the controller 300 stops the steering of the second outboard motor 100S (S150). After stopping the steering, the controller 300 proceeds to step S160.

In step S160, the controller 300 outputs command signals to tilt up the outboard motors 100P, 100S via the ECU 190P, 190S to the tilt actuators 174P, 174S. The tilt actuator 174P drives the tilting device 170P based on the received command signal to rotate the outboard motor main body 101 of the first outboard motor 100P to the predetermined upper limit position of the tilt-up state. The tilt actuator 174S drives the tilting device 170S based on the received command signal to rotate the outboard motor main body 101 of the second outboard motor 100S to the predetermined upper limit position of the tilt-up state. The tilt-up of the outboard motors 100P, 100S may be performed in parallel.

After outputting a command signal to the tilt actuator 174P, 174S, the controller 300 proceeds to step S170.

In step S170, the controller 300 determines whether or not an intervention action has been taken by the user to cancel the batch tilt up, in the same way as step S140. When it is determined that an intervention action has been taken, the controller 300 proceeds to step S200 and cancels the batch tilt up operation. When it is determined that no intervention action has been taken, the controller 300 continues the tilt operation without any other operation.

The controller 300 receives an angle signal indicating the tilt/trim angle of the first outboard motor 100P from the attitude sensor 175P, and when it is determined that the outboard motor main body 101 of the first outboard motor 100P has reached the upper limit position of the tilt-up state, the controller 300 stops the tilt-up of the first outboard motor 100P. The controller 300 receives an angle signal indicating the tilt/trim angles of the second outboard motor 100S from the attitude sensor 175S, and when it is determined that the outboard motor main body 101 of the second outboard motor 100S has reached the upper limit position of the tilt-up state, the controller 300 stops the tilt-up of the second outboard motor 100S (S180). After stopping the tilt-up, the controller 300 proceeds to step S190.

In step S190, the controller 300 outputs a command signal to the notification device 400 to instruct it to stop outputting the warning sound. The notification device 400 stops outputting the warning sound based on the received command signal.

The boat control system 600 according to an example embodiment may be switchable between a first tilt mode and a second tilt mode when the batch PTT switch 224 is operated by the user, i.e., when the batch tilt-up instruction is accepted. The first tilt mode executes the steps (S130 to S150) of steering the outboard motors 100P, 100S until their steering angles reach the neutral state and the steps (S160 to S180) of tilting up, and the second tilt mode executes the steps (S160 to S180) of tilting up without executing the steps (S130 to S150) of steering the outboard motors 100P, 100S until their steering angles reach the neutral state. The two tilt modes can be switched by a serviceperson of the boat builder or dealer by inputting the tilt mode setting information to an external device connected to the input port 500 via a wired or wireless connection.

As described above, the boat 1 includes the boat body 10 and the boat control system 600. The boat control system 600 includes the first outboard motor 100P, the second outboard motor 100S, and the controller 300. The first outboard motor 100P includes the steering device 160P to change the steering angle and the tilting device 170P to perform tilt operations. Similarly, the second outboard motor 100S includes the steering device 160S and the tilting device 170S. The controller 300 controls the steering devices 160P, 160S and the tilting devices 170P, 170S. Upon receiving a batch tilt-up instruction, which is a tilt operation instruction for all outboard motors 100P, 100S, when at least one of the outboard motors 100P, 100S is in a state different from the neutral state, the controller 300 drives the steering devices 160P, 160S to steer the outboard motors 100P, 100S until their steering angles reach the neutral state to complete the steering, and then drives the tilting devices 170P, 170S to perform the tilt-up.

According to the above configuration, the user does not need to separately perform a steering operation to make the steering angles reach the neutral state during a batch tilt up, which reduces the amount of work required by the user when performing the batch tilt up. In addition, interference of the outboard motors 100P, 100S with the boat body 10 is effectively prevented.

The boat control system 600 further includes the notification device 400 controlled by the controller 300 to inform the surroundings that the tilt operation is about to be performed. The controller 300 causes the notification device 400 to perform the notification before starting the steering operation. With this configuration, a tilt operation can be performed after alerting the surroundings before starting the steering and tilt operations.

The controller 300 stops the steering and tilt up operations when receiving a steering operation instruction or a trim operation instruction after receiving a batch tilt up instruction. With this configuration, if the user issues a tilt operation instruction by mistake, it is easy to cancel the operation.

When the controller 300 detects an abnormality in the steering devices 160P, 160S or the tilting devices 170P, 170S, the controller 300 does not perform a steering or tilt up operation even if it receives a batch tilt up instruction. This configuration can prevent interference of the outboard motors 100P, 100S with the boat body 10 caused by the outboard motors 100P, 100S not moving as the user intended.

The controller 300 performs the steering and tilt up when it receives a batch tilt up instruction, and the controller 300 performs tilt up without performing steering when it receives a tilt up instruction for one of the outboard motors 100P, 100S. With this configuration, it is possible to perform tilt operations for one of the two outboard motors 100P, 100S with a steering angle that is different from the neutral state as necessary, such as during maintenance, which improves convenience.

The boat control system 600 is switchable between a first tilt mode to perform (i) and (ii) when receiving a tilt up instruction and a second tilt mode that performs (ii) without performing (i) when receiving a tilt up instruction. With such a configuration, it is possible to perform tilt operations with the steering angle in a state different from the neutral state as necessary, such as during maintenance, which improves convenience.

The technologies disclosed herein are not limited to the above-described example embodiments and may be modified in various ways without departing from the gist of the present invention, including the following modifications.

In the above example embodiments, the outboard motors 100P, 100S are outboard motors driven by an engine, but the outboard motors can also be electric outboard motors driven by a motor.

In the above example embodiments, both of the two outboard motors 100P, 100S include the steering actuators 164P, 164S that can communicate with the controller 300, but only one outboard motor may include a steering actuator 164P that can communicate with the controller 300, and the other outboard motor may be connected to the one outboard motor by a tie bar, thus enabling multiple outboard motors to be steered.

The above example embodiments show an example in which (ii) is executed after (i) is completed, but for example, (i) and (ii) may be started simultaneously, or (ii) may be started after (i) is started but before (i) is completed.

In the above example embodiments, the controller 300 causes the notification device 400 to perform the notification before executing the steering but the notification may not be performed.

In the above example embodiments, a device that emits a warning sound is exemplified as an example of the notification device 400 but the notification device can also be a warning light that emits light, or a display that displays a warning message.

In the above example embodiments, the boat control system 600 includes two outboard motors 100P, 100S, but the number of boat propulsion devices provided in the boat control system may be only one or three or more.

The above example embodiments show an example in which (i) and (ii) are executed when the controller 300 receives a batch tilt up instruction, but when the boat control system is provided with only one boat propulsion device, (i) and (ii) may be executed for that boat propulsion device when the controller receives a tilt operation instruction for that boat propulsion device. Also, in the case where the boat control system is provided with two or more boat propulsion devices, when the controller accepts a tilt operation instruction for some of the boat propulsion devices, (i) and (ii) may be executed for those boat propulsion devices.

In the above example embodiments, a boat for towing a wakeboard is exemplified as the boat 1, but the boat does not have to be a boat for towing a wakeboard. Also, in the above example embodiments, the boat 1 is provided with a frame 20, but the technologies disclosed herein may be applied to boats including structures that can interfere with the boat propulsion device other than the frame, such as a hatch covering the outboard motor.

The above example embodiments show an example in which the user operates the batch PTT switch 224 to issue a tilt operation instruction, but the tilt operation instruction may also be issued by, e.g., an operation of a touch panel provided on the operation device, an operation of a gauge that displays information of the engine, or an operation of a switch provided on a wireless key.

The above example embodiments show an example in which (i) and (ii) are executed when the tilt operation is a tilt up, but it is also possible for (i) and (ii) to be executed when the tilt operation is a tilt down.

The above example embodiments show an example of switching between the first tilt mode and the second tilt mode by inputting setting information to an external device connected to the input port 500, but the device that accepts switching between the two tilt modes can be, e.g., a touch panel provided on the operation device or a gauge that displays information of the engine.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a boat including a boat body, the system comprising:

a boat propulsion device including a steering device to change a steering angle and a tilting device to perform tilt operations; and a controller configured or programmed to control the steering device and the tilting device; wherein upon receiving a tilt operation when the steering angle of the boat propulsion device is in a state different from a neutral state, the controller is configured or programmed to:

(i) drive the steering device to steer the boat propulsion device until the steering angle of the boat propulsion device reaches the neutral state; and (ii) drive the tilting device to perform the tilt operation at a same time as (i) or after a start of (i).

2. The boat control system according to claim 1, wherein the controller is configured or programmed to perform (ii) after a completion of (i).

3. The boat control system according to claim 1, further comprising:

a notifier controlled by the controller to issue a notification to surroundings of the boat that the tilt operation is about to be performed; wherein the controller is configured or programmed to cause the notifier to issue the notification before starting (i).

4. The boat control system according to claim 2, further comprising:

a notifier controlled by the controller to issue a notification to surroundings of the boat that the tilt operation is about to be performed; wherein the controller is configured or programmed to cause the notifier to issue the notification before starting (i).

5. The boat control system according to claim 1, wherein the controller is configured or programmed to stop (i) and (ii) upon receiving a steering operation instruction or a trim operation instruction after receiving a tilt operation instruction.

6. The boat control system according to claim 2, wherein the controller is configured or programmed to stop (i) and (ii) upon receiving a steering operation instruction or a trim operation instruction after receiving a tilt operation instruction.

7. The boat control system according to claim 1, wherein the controller is configured or programmed to detect an abnormality in the steering device or the tilting device; and when the controller detects the abnormality in the steering device or the tilting device, the controller is configured or programmed to not perform (i) and (ii) even when the controller receives a tilt operation instruction.

8. The boat control system according to claim 2, wherein the controller is configured or programmed to detect an abnormality in the steering device or the tilting device; and when the controller detects the abnormality in the steering device or the tilting device, the controller is configured or programmed to not perform (i) and (ii) even when the controller receives a tilt operation instruction.

9. The boat control system according to claim 1, wherein the boat control system includes a plurality of boat propulsion devices; and the controller is configured or programmed to:

perform (i) and (ii) when the controller receives a tilt operation instruction for all of the plurality of boat propulsion devices; and perform (ii) without performing (i) when the controller receives a tilt operation instruction for some, but not all, of the plurality of boat propulsion devices.

10. The boat control system according to claim 2, wherein the boat control system includes a plurality of boat propulsion devices; and the controller is configured or programmed to:

perform (i) and (ii) when the controller receives a tilt operation instruction for all of the plurality of boat propulsion devices; and perform (ii) without performing (i) when the controller receives a tilt operation instruction for some, but not all, of the plurality of boat propulsion devices.

11. The boat control system according to claim 1, wherein the controller is configured or programmed to switch between a first tilt mode to perform (i) and (ii) when receiving a tilt operation instruction, and a second tilt mode to perform (ii) without performing step (i) when receiving a tilt operation instruction.

12. The boat control system according to claim 2, wherein the controller is configured or programmed to switch between a first tilt mode to perform (i) and (ii) when receiving a tilt operation instruction, and a second tilt mode to perform (ii) without performing step (i) when receiving a tilt operation instruction.

13. A boat comprising:

the boat control system according to claim 1.

14. A boat comprising:

the boat control system according to claim 2.

* * * * *